US012000392B2

(12) United States Patent
Liu et al.

(10) Patent No.: US 12,000,392 B2
(45) Date of Patent: Jun. 4, 2024

(54) SCROLL COMPRESSOR

(71) Applicant: Copeland Climate Technologies (Suzhou) Co. Ltd., Jiangsu (CN)

(72) Inventors: Xuan Liu, Suzhou (CN); Qiongyu Zhang, Suzhou (CN)

(73) Assignee: Copeland Climate Technologies (Suzhou) Co. Ltd., Jiangsu (CN)

( * ) Notice: Subject to any disclaimer, the term of this patent is extended or adjusted under 35 U.S.C. 154(b) by 143 days.

(21) Appl. No.: 17/614,261

(22) PCT Filed: May 25, 2020

(86) PCT No.: PCT/CN2020/091986
§ 371 (c)(1),
(2) Date: Nov. 24, 2021

(87) PCT Pub. No.: WO2020/238825
PCT Pub. Date: Dec. 3, 2020

(65) Prior Publication Data

US 2022/0243730 A1 Aug. 4, 2022

(30) Foreign Application Priority Data

May 24, 2019 (CN) ..... 201910440249.7
May 24, 2019 (CN) ..... 201920765067.2

(51) Int. Cl.
*F04C 18/02* (2006.01)
*F04C 28/14* (2006.01)
*F04C 29/12* (2006.01)

(52) U.S. Cl.
CPC ..... *F04C 18/0215* (2013.01); *F04C 29/12* (2013.01); *F04C 18/0261* (2013.01); *F04C 28/14* (2013.01)

(58) Field of Classification Search
CPC ..... F04C 29/126; F04C 28/24; F04C 29/12; F04C 18/0253; F04C 18/0215; F04C 28/10; F04C 28/14; F04C 18/0261; F04C 23/008
See application file for complete search history.

(56) References Cited

U.S. PATENT DOCUMENTS 5,996,364 A * 12/1999 Lifson ..... F25B 49/022 62/196.1
6,883,341 B1 * 4/2005 Lifson ..... F25B 49/022 62/200
(Continued)

FOREIGN PATENT DOCUMENTS

CN 1576602 A 2/2005
CN 103362802 A 10/2013
(Continued)

OTHER PUBLICATIONS

Extended European Search Report mailed May 16, 2023, in corresponding European Application No. 20812649.0.
(Continued)

*Primary Examiner* — Anthony Ayala Delgado
(74) *Attorney, Agent, or Firm* — Harness, Dickey & Pierce, P.L.C.

(57) ABSTRACT

Disclosed is a scroll compressor including: an orbiting scroll having an orbiting scroll end plate and an orbiting volute formed on one side of the orbiting scroll end plate, and a fixed scroll having a fixed scroll end plate and a fixed volute formed on one side of the fixed scroll end plate. The fixed and orbiting scrolls match each other in order to form a series of compression cavities therebetween including a central compression cavity and middle compression cavities located radially outside of the central compression cavity, and. The middle compression cavities include at least a set of a first middle compression cavity and a second middle
(Continued)

compression cavity. A fluid channel selectively communicating with a discharge area is provided between the first and second middle compression cavities, and the first middle compression cavity directly communicates with the second middle compression cavity by means of the fluid channel.

13 Claims, 11 Drawing Sheets

(56) References Cited

U.S. PATENT DOCUMENTS

| | | | | |
|---|---|---|---|---|
| 8,568,118 | B2 * | 10/2013 | Stover | F04C 28/26 418/55.5 |
| 2005/0019179 | A1 | 1/2005 | Shin et al. | |
| 2008/0184733 | A1 | 8/2008 | Skinner | |
| 2017/0342981 | A1 | 11/2017 | Mizushima et al. | |

FOREIGN PATENT DOCUMENTS

| | | | |
|---|---|---|---|
| CN | 204511881 | U | 7/2015 |
| CN | 107002674 | A | 8/2017 |
| CN | 210218102 | U | 3/2020 |
| EP | 0972942 | A2 | 1/2000 |
| EP | 2007292030 | A | 11/2007 |
| EP | 2014208985 | A | 11/2014 |
| JP | H04370383 | A | 12/1992 |
| JP | H07293456 | A | 11/1995 |
| JP | H11166490 | A | 6/1999 |

OTHER PUBLICATIONS

International Search Report and Written Opinion dated Aug. 24, 2020, in corresponding International Application No. PCT/CN2020/091986 (with translation).

First Office Action regarding Chinese Patent Application No. 201910440249.7 issued Jan. 5, 2024.

* cited by examiner

SCROLL COMPRESSOR

The present application is the national phase of International Application No. PCT/CN2020/091986, title "SCROLL COMPRESSOR", filed of May 25, 2020, which claims the priorities to the Chinese patent applications Nos. 201910440249.7 and 201920765067.2 titled "SCROLL COMPRESSOR" and filed with the China National Intellectual Property Administration on May 24, 2019. These applications are incorporated herein by reference.

FIELD

The present disclosure relates to the technical field of scroll compressor, and in particular to a scroll compressor with function of variable volume ratio.

BACKGROUND

This section only provides background information related to the present application, which is not necessarily the prior art.

Compressors may be used in application systems that require different pressures, such as air-conditioning systems, refrigeration systems, etc. Therefore, there may be cases where the discharge pressure of the compression chamber (the maximum pressure in the compression chamber) is higher than the pressure required by a specific application system, that is, there may be over-compression. In the case of over-compression, the discharge pressure of the compressed fluid is reduced to the pressure required by the application system after it is discharged from the compression chamber, so the compressor does unnecessary work, which may reduce the efficiency of the compressor.

In order to reduce or prevent over-compression of the working fluid, compressors with function of a variable volume ratio (VVR) have been developed. This type of compressor may use the VVR valve set in the VVR orifice to achieve a variable volume ratio. That is, the compressor operates at a low volume ratio when the pressure required by the system is low and operates at a high volume ratio when the pressure required by the system is high, thereby effectively avoiding over-compression and improving the efficiency of the compressor. However, in the compressor field, there are still technical problems that the VVR function cannot be realized because the VVR valve cannot be provided due to the limited installation space, or the structure for realizing the VVR function is complicated with the high cost.

SUMMARY

An object of one or more embodiments of the present disclosure is to provide a compressor having a variable volume ratio mechanism that is not restricted by the installation space and has a simple structure.

Another object of one or more embodiments of the present disclosure is to provide a compressor having a variable volume ratio mechanism suitable for a small displacement compressor provided with a fixed scroll hub.

Another object of one or more embodiments of the present disclosure is to provide a compressor having a variable volume ratio mechanism that is highly compatible and can be realized in a simple and quick manner.

Another object of one or more embodiments of the present disclosure is to provide a compressor having a variable volume ratio mechanism that requires fewer new parts to be developed, and therefore has low development difficulty at high development speed.

Another object of one or more embodiments of the present disclosure is to provide a compressor having a variable volume ratio mechanism that can operate reliably with no split design, no cover plate, and low leakage.

According to an aspect of the present disclosure, a scroll compressor is provided, including: a movable scroll including a movable scroll end plate and a movable volute formed on one side of the movable scroll end plate; and a fixed scroll including a fixed scroll end plate and a fixed volute formed on one side of the fixed scroll end plate, wherein the fixed scroll and the movable scroll are engaged to form a series of compression cavities therebetween. The series of compression cavities include a central compression cavity and intermediate compression cavities located radially outside of the central compression cavity. The intermediate compression cavities includes at least a set of a first intermediate compression cavity and a second intermediate compression cavity with a fluid channel provided therebetween for selectively communicating with a discharge area, and the first intermediate compression cavity and the second intermediate compression cavity are directly communicated through the fluid channel.

According to an aspect of the present disclosure, the scroll compressor includes: a main discharge port and an auxiliary discharge port provided at the fixed scroll end plate. The main discharge port is in fluid communication with the central compression cavity, and the auxiliary discharge port is shared by the first intermediate compression cavity and the second intermediate compression cavity to be selectively in fluid communication with the discharge area.

According to an aspect of the present disclosure, the fluid channel includes a first section communicating with the first intermediate compression cavity, a second section communicating with the second intermediate compression cavity, and a connecting section connecting the first section and the second section.

According to an aspect of the present disclosure, the fluid channel is arranged in the fixed scroll end plate. The connecting section includes a first connecting section communicating with the first section and a second connecting section communicating with the second section. The first connecting section and the second connecting section intersect. The auxiliary discharge port is in direct fluid communication with one of the first intermediate compression cavity and the second intermediate compression cavity.

According to an aspect of the present disclosure, the fluid channel is provided in the movable scroll end plate, and the connecting section is formed as a single section. The auxiliary discharge port is in direct fluid communication with one of the first intermediate compression cavity and the second intermediate compression cavity.

According to an aspect of the present disclosure, the connecting section has a first end penetrating the fixed scroll end plate or the movable scroll end plate, and a plug for preventing fluid leakage is provided at the first end.

According to an aspect of the present disclosure, the fluid channel is provided on at least one of the fixed volute and the movable volute.

According to an aspect of the present disclosure, the fluid channel includes a trench provided on the end surface of the free end of the fixed volute and/or the movable volute, and a first slot and a second slot extending from the trench and communicating with the first intermediate compression cavity and the second intermediate compression cavity respectively.

According to an aspect of the present disclosure, the fixed scroll end plate is formed with an inner annular wall on the side opposite to the fixed volute. The main discharge port and the auxiliary discharge port are arranged radially inside of the inner annular wall, and the discharge area is defined by the inner annular wall. A variable volume ratio valve is provided at the auxiliary discharge port. The variable volume ratio valve allows fluid to flow from the first intermediate compression cavity and the second intermediate compression cavity into the discharge area, and prevents fluid from flowing from the discharge area into the first intermediate compression cavity and the second intermediate compression cavity.

According to an aspect of the present disclosure, the variable volume ratio valve includes a single valve flap covering the variable volume ratio orifice and a valve stop controlling the maximum movement range of the valve flap. The valve flap includes a fixed part and a single movable part, and the movable part is movable between an open position and a closed position with respect to the fixed part.

The compressor structure according to the present disclosure can not only be free from the limitation of installation space, but also realize VVR function with simple structure.

BRIEF DESCRIPTION OF THE DRAWINGS

The drawings described herein are for illustrative purposes only, and are not intended to limit the scope of the present disclosure in any way.

DETAILED DESCRIPTION OF THE EMBODIMENTS

Figure 1:
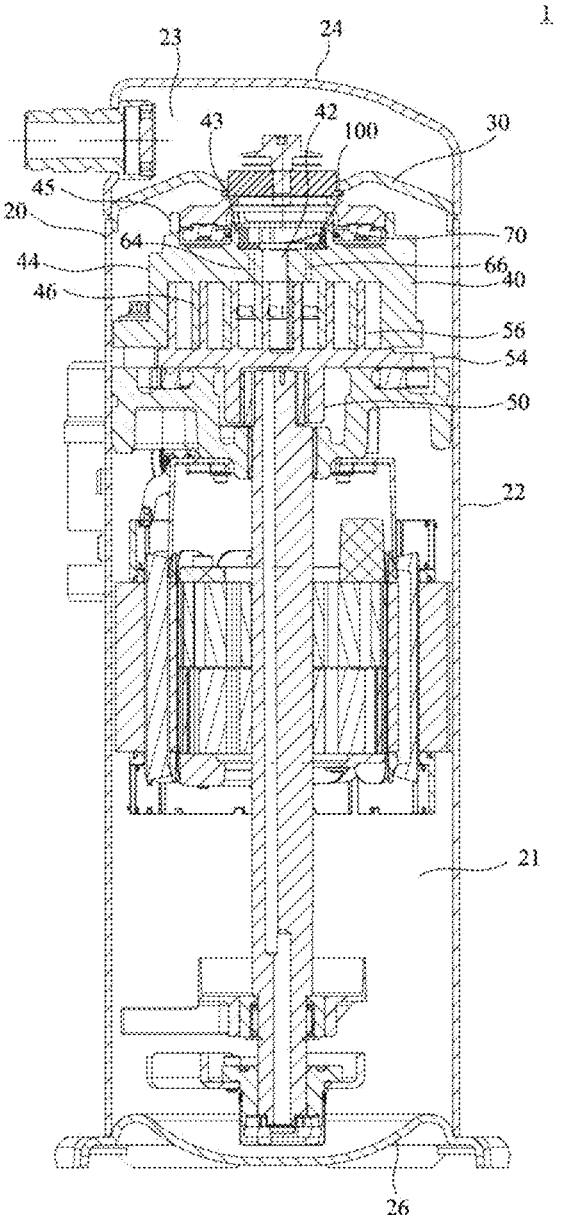
FIG. 1 is a cross-sectional view schematically showing a compressor with a VVR function according to a first comparative example.

The following description of various embodiments of this disclosure is only illustrative and is by no means intended to limit this disclosure and the application or usage thereof. The same reference numerals are used in the various drawings to denote the same components, and therefore, the configuration of the same components will not be described repeatedly.

Figure 2:
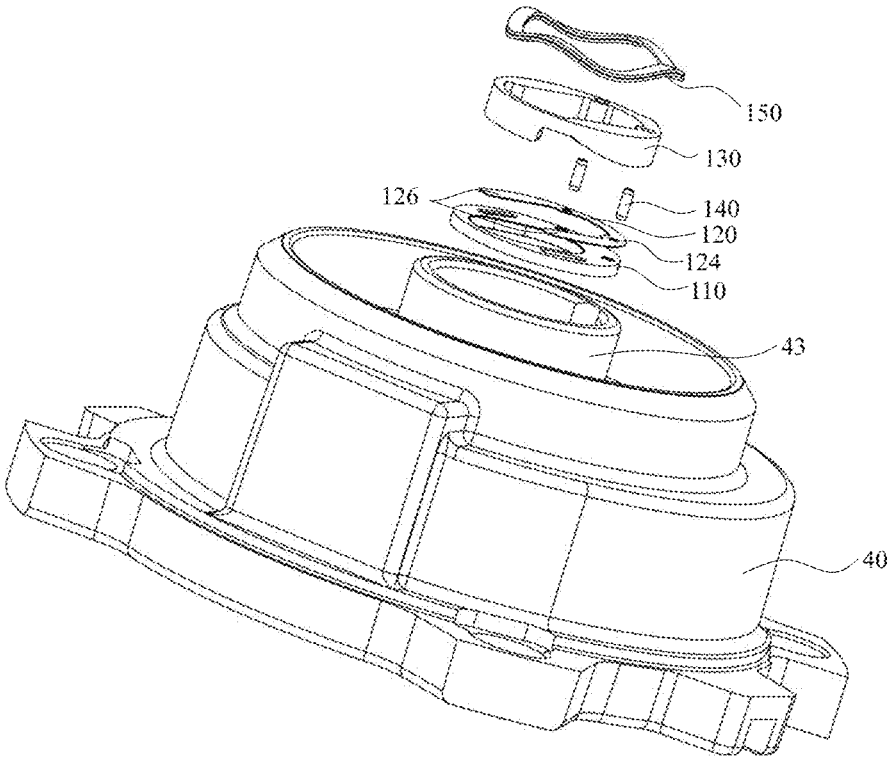
FIG. 2 is a perspective view schematically showing a fixed scroll and a VVR valve of a compressor with a VVR function according to the first comparative example.
Figure 3A:
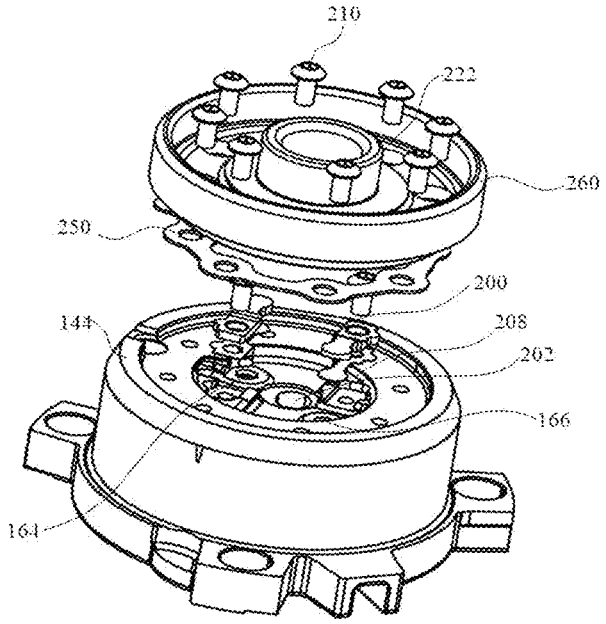
FIG. 3A is a perspective view schematically showing a fixed scroll and a VVR valve of a compressor with a VVR function according to a second comparative example.
Figure 3B:
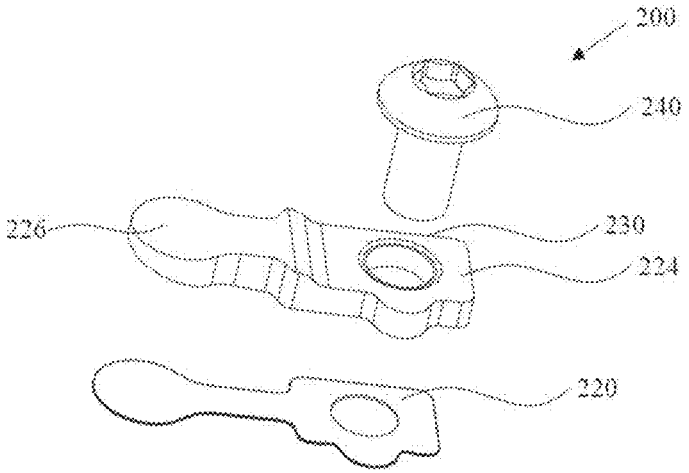
FIG. 3B shows details of the VVR valve according to the second comparative example.

The compressors with VVR function according to the comparative examples will be described below with reference to FIGS. 1 to 3B. FIG. 1 is a cross-sectional view schematically showing a compressor with a VVR function according to a first comparative example; FIG. 2 is a perspective view schematically showing a fixed scroll and a VVR valve of a compressor with a VVR function according to a first comparative example; and FIGS. 3A and 3B schematically show a fixed scroll and a VVR valve of a compressor with a VVR function according to a second comparative example.

As shown in FIG. 1, the compressor 1 includes a substantially closed housing 20. The housing 20 may be constituted by a substantially cylindrical body portion 22, a top cover 24 arranged at one end of the body portion 22, and a bottom cover 26 arranged at the other end of the body portion 22. A partition plate 30 is arranged between the top cover 24 and the body portion 22 to partition an internal space of the housing 20 into a fluid suction chamber 21 and a fluid discharge chamber 23. The fluid discharge chamber 23 is defined between the partition plate 30 and the top cover 24, and the fluid suction chamber 21 is defined among the partition plate 30, the body portion 22 and the bottom cover. A suction joint for sucking fluid is provided on the side of the fluid suction chamber 21, and a discharge joint for discharging the compressed fluid is provided on the side of the fluid discharge chamber 23.

A compression mechanism and a drive mechanism for driving the compression mechanism are provided in the housing 20. The compression mechanism sucks fluid from the fluid suction chamber 21 of the housing 20 and compresses the fluid and discharges the fluid into the fluid discharge chamber 23 of the housing 20. More specifically, Referring to FIG. 1, for example, the compression mechanism may include a fixed scroll 40 and a movable scroll 50. The movable scroll 50 includes an end plate 54 and a spiral volute 56 formed on one side of the end plate. The fixed scroll 40 includes an end plate 44 and a spiral volute 46 formed on one side of the end plate. The end plate 44 includes an discharge port 42 formed at a substantially central position of the end plate, and a first variable volume ratio orifice 64 and a second variable volume ratio orifice 66 which are located radially outside the discharge port 42. The volute 46 of the fixed scroll 40 and volute 56 of movable scroll 50 mesh with each other to form a series of compression cavities with gradually decreasing volume and gradually increasing pressure from radially outer side to radially inner side. Specifically, among the compression cavities, the radially outermost compression cavity has the smallest pressure; the radially innermost compression cavity, that is, the central compression cavity C1 at the center of the scroll, has the largest pressure; and multiple intermediate compression cavities located between the radially outermost position and the innermost position have an intermediate pressure between the largest pressure and the smallest pressure. The discharge port 42 is in fluid communication with the central compression cavity (the fluid communication described herein corresponds to direct fluid communication), and the first and second variable volume ratio orifices 64 and 66 are respectively in fluid communication with two intermediate compression cavities C2 and C3 located on opposite sides of the central compression cavity.

In order to achieve the axial seal between the top end of the volute 46 of the fixed scroll 40 and the end plate 54 of the movable scroll 50 and between the top end of the volute 56 of the movable scroll 50 and the end plate 44 of the fixed scroll 40, generally, a back pressure cavity 70 is provided on the side of the end plate 44 of the fixed scroll 40 opposite to the volute 46. More specifically, an inner annular wall 43 and an outer annular wall 45 are formed on the end plate 44. The inner annular wall 43 is formed around the discharge port 42. The back pressure cavity 70 is defined by an end plate 44, an inner annular wall 43 and an outer annular wall 45, and is closed by a sealing assembly provided therein. The back pressure cavity 70 is in fluid communication with one of the medium pressure cavities between the movable scroll 50 and the fixed scroll 40 through an axially extending through hole (not shown) formed in the end plate 44, thereby generating a force to press the fixed scroll 40 toward the movable scroll 50. The fixed scroll 40 and the movable scroll 50 can be effectively pressed together by the pressure in the back pressure cavity 70.

In the discharge area defined by the inner annular wall 43, a variable volume ratio valve 100 (hereinafter referred to as a VVR valve) is provided to prevent excessive compression of the working fluid. As specifically shown in FIG. 2, the VVR valve 100 includes a valve plate 110, a valve flap 120, a valve retainer 130, a pin 140 and a wave spring 150. The valve plate 110 is provided with a first fluid through hole and a second fluid through hole at positions corresponding to the first variable volume ratio orifice 64 and the second variable volume ratio orifice 66. The valve flap 120 is provided on the valve plate 110 to selectively open or close the fluid through holes. The valve flap 120 has two symmetrical movable parts 126 and one fixed part 124. The two movable parts 126 may be displaced relative to the fixed part 124 between an open position and a closed position. The valve retainer 130 is provided on the valve flap 120. The pin 140 extends through pin holes formed in the valve flap, the valve plate, and the valve retainer to circumferentially fix the valve plate 110, the valve flap 120, and the valve retainer 130. The wave spring 150 axially holds the valve flap, the valve plate and the valve retainer together.

During the operation of the compressor 1, the working fluid is sucked into the compression mechanism and compressed as it flows from the radially outermost position to the radially innermost position, and the compressed fluid is discharged to the discharge area defined by the inner annular wall 43 through the discharge port 42, and then discharged to the discharge chamber 23 via a one-way valve provided at the central position of the partition plate 30. In case of excessive compression, the fluid can be discharged to the discharge area through the VVR valve 100 in advance before reaching the radially innermost position. Specifically, when the pressure of the fluid in the compression cavity at the radial middle position is greater than the pressure of the fluid in the discharge chamber 23 (that is, excessive compression occurs), the pressure on the lower side of the valve flap 120 is greater than the pressure on the upper side, and the valve flap 120 moves toward the open position under the pressure difference, thereby allowing the fluid to be discharged in advance through the variable volume ratio orifices 64, 66 and the fluid through holes. In case that the pressure of the fluid contained in the compression cavity at the radial middle position is less than the pressure of the fluid in the discharge chamber 23, the valve flap 120 returns to the closed position under the elastic restoring force and the pressure difference, thereby sealing the variable volume ratio orifices 64 and 66.

In the compressor 1, in order to enable the back pressure cavity 70 to provide stable and sufficient pressure to effectively prevent fluid leakage between compression cavities, it is necessary to ensure that the back pressure cavity 70 has enough space, so the space inside the inner annular wall 43 is very limited. In particular, for a small displacement scroll compressor, the space inside the inner annular wall 43 may only have a diameter of 20 mm-30 mm. In this case, it is difficult to fit the VVR valve 100 in the inside of the annular wall 43 to realize the compressor VVR function.

Furthermore, FIGS. 3A and 3B schematically show a fixed scroll and a VVR valve of a compressor with a VVR function according to a second comparative example, with the other configuration of the compressor being basically the same as the corresponding configuration of the compressor according to the first comparative example. The compressor according to the second comparative example uses a cover plate 220 to separate the discharge area and the back pressure cavity respectively at the lower and upper parts, so that the installation space of the VVR valve is not limited by the size of the back pressure cavity as in the first comparative example. Specifically, referring to FIG. 3A, the fixed scroll end plate 144 and the cover plate 220 are fastened together by multiple screws 210. A groove 208 is provided on the side of the fixed scroll end plate 144 opposite to the volute, and is formed around the discharge port 202 and the variable volume ratio orifices 164 and 166, thereby forming an discharge area in the groove 208 (i.e., the lower side of the cover plate 220).

A VVR valve 200 is arranged on each of variable volume ratio orifices 164 and 166. The VVR valve 200 allows fluid in the compression cavity to flow into the discharge area, and prevents fluid in the discharge area from flowing into the compression cavity. The VVR valve 200 may include a valve flap 220 covering the variable volume ratio orifice 164 or 166 and a valve stop 230 that prevents the valve flap 220 from being excessively deformed. The valve flap 220 has a movable part 226 and a fixed part 224, and the movable part 226 may be displaced relative to the fixed part 224 between an open position and a closed position. The VVR valve 200 may be fixed to the valve fixing hole formed in the fixed scroll end plate 144 by a fastener 240 such as a screw.

A concave portion 222 is formed on the upper side of the cover plate 220, and is in fluid communication with the medium pressure cavity of the compression cavities through a medium pressure hole, and a sealing assembly may be provided in the concave portion 222 to form a back pressure cavity that provides an axial sealing force to the fixed scroll. A gasket 250 is provided between the cover plate 220 and the fixed scroll end plate 144.

However, in the compressor according to the second comparative example, the use of an additional cover plate 220, a sealing gasket 250 and corresponding fasteners causes complicated structure, increased cost of parts and increased installation time. In addition, since the discharge area between the cover plate 220 and the fixed scroll end plate 144 has a large pressure, there is a risk of fluid leakage caused from difficulty in completely sealing between the cover plate 220 and the fixed scroll end plate 144 which are connected by screws.

In order to solve the above problems, the inventor conceived an improved compressor structure, which can realize the VVR function not only with no limit of the installation space but also with a simple structure.

Hereinafter, the compressor with VVR function according to the present disclosure will be described in further detail with reference to FIGS. 4 to 14B. The same reference numerals in the drawings denote the same components, and detailed descriptions of these components will be omitted.

Figure 4:
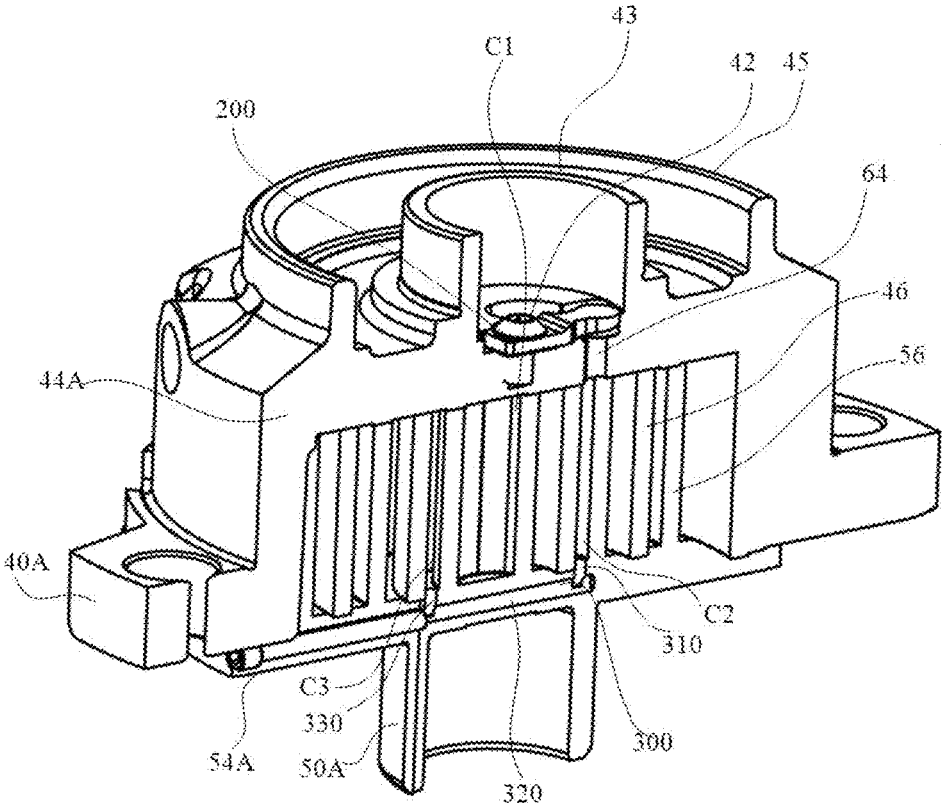
FIG. 4 schematically shows the fixed scroll and the movable scroll of the compressor according to the first embodiment of the present disclosure.

As shown in FIG. 4, the compressor according to the first embodiment of the present disclosure includes a fixed scroll 40A and a movable scroll 50A. Similar to the fixed scroll 40 and the movable scroll 50 according to the first comparative example, the volute 46 of the fixed scroll 40A and volute 56 of movable scroll 50A mesh with each other to form a series of compression cavities with gradually decreasing volume and gradually increasing pressure from radially outer side to radially inner side. Among the compression cavities, the radially outermost compression cavity has the smallest pressure; the radially innermost compression cavity, that is, the central compression cavity at the center of the scroll has the largest pressure; and the multiple intermediate compression cavities located between the radially outermost position and the innermost position have an intermediate pressure between the largest pressure and the smallest pressure.

The end plate 44A of the fixed scroll 40A is provided with a central discharge port 42 and a variable volume ratio orifice 64. The central discharge port 42 may be in fluid communication with the central compression cavity C1 of the compression cavities, and the variable volume ratio orifice 64 may be in fluid communication with the first intermediate compression cavity C2 located radially outside the central compression cavity (right side in FIG. 4). A second intermediate compression cavity C3 is formed on the opposite side of the central compression cavity (i.e., the left side in FIG. 4), and may be symmetrical to the first intermediate compression cavity C2 with respect to the central compression cavity C1. It should be noted here that, in the description of the present application, the intermediate compression cavities that have substantially the same pressure and cavity volume during the operation of the compressor are called a set of first intermediate compression cavity and second intermediate compression cavity. The fluid is discharged from the set of intermediate compression cavities at the same time, so as to avoid over-compression or under-compression of one of the compression cavities caused by discharging at different times and to reduce the loss of constant volume compression of the compressor. In a symmetrical single-scroll compressor, the compression cavities is symmetrical with respect to the central compression cavity, and the pressure and volume in the two symmetrical compression cavities are basically the same, which can be used as a set of intermediate compression cavities. In a dual-scroll compressor, two sets of (i.e., four) intermediate compression cavities with the approximately same pressure and volume may exist at the same time. In the asymmetric scroll design, the compression cavities formed by the fixed scroll and the movable scroll is asymmetric with respect to the central compression cavity. Therefore, the first intermediate compression cavity C2 and the second intermediate compression cavity C3 are also asymmetric. However, it should be understood that, in the case of asymmetrical conditions, the technical idea of arranging the fluid channels described below according to the present disclosure is also applicable.

The compressor according to the first embodiment of the present disclosure is provided with a fluid channel 300 between the first intermediate compression cavity C2 and the second intermediate compression cavity C3 to directly communicate the two compression cavities. As shown in FIG. 4, the fluid channel 300 may be formed in the end plate 54A of the movable scroll 50A, and may include a first section 310, a second section 330, and a transverse connecting section 320. The first section 310 and the second section 330 may extend along the axial direction of the compressor and communicate with the first intermediate compression cavity C2 and the second intermediate compression cavity C3 respectively. The transverse connection section 320 may extend in a transverse direction perpendicular to the axial direction of the compressor and connect the first axial section 310 and the second axial section 330. Therefore, the fluid in the second intermediate compression cavity C3 may flow to the first intermediate compression cavity C2 through the second axial section 330, the transverse connecting section 320 and the first axial section 310 in turn, and then may be discharged from the first intermediate compression cavity C2 to the discharge area defined by the annular wall 43 via the variable volume ratio orifice 64. Preferably, the transverse connecting section 320 of the fluid channel 300 may be formed as a single section to reduce the clearance volume of the compressor. Furthermore, although the first section 310 and the second section 330 are described herein to extend in the axial direction of the compressor, it should be understood that the first section 310 and the second section 330 may also extend in a slightly inclined direction. Preferably, the first section 310 and the second section 330 extending axially are used to reduce the clearance volume of the compressor.

In the compressor according to the first embodiment of the present disclosure, a single VVR valve 200 may be provided on the variable volume ratio orifice 64. The VVR valve 200 may include a valve flap 220 covering the variable volume ratio orifice 64 and a valve stop 230 that prevents the valve flap 220 from being excessively deformed. The valve flap 220 may have a movable part 226 and a fixed part 224, and the movable part 226 may be displaced between an open position and a closed position relative to the fixed part 224. In the closed position, the valve flap 220 closes the variable volume ratio orifice 64, while in the open position, the valve flap 220 opens the variable volume ratio orifice 64 and allows fluid to flow from the first intermediate compression cavity C2 to the discharge area defined by the annular wall 43. The VVR valve 200 may be fixed to a valve fixing hole formed in the end plate 44A of the fixed scroll 40A by a fastener such as a screw.

During the operation of the compressor according to the first embodiment of the present disclosure, the working fluid is sucked into the compression mechanism and compressed as it flows from the radially outermost position to the radially innermost position, and the compressed fluid is discharged to the discharge area defined by the inner annular wall 43 through the discharge port 42, and then discharged to the discharge chamber 23 through a one-way valve provided at the center of the partition plate 30. In the case of excessive compression, the fluid may be discharged to the discharge area in advance through the VVR valve 200 before reaching the radially innermost central compression cavity C1. Specifically, in case that the pressure of the fluid in the first intermediate compression cavity C2 and the second intermediate compression cavity C3 at the radially intermediate position is greater than the fluid pressure in the discharge chamber 23 (that is, excessive compression occurs), the pressure at the lower side of the valve flap 220 is greater than the pressure at the upper side, and the movable part 226 of the valve flap 220 moves toward the open position under the pressure difference, thus allowing the fluid to be discharged from the intermediate compression cavities C2 and C3 to the discharge area in advance through the variable volume ratio orifice 64. In case that the pressure of the fluid in the first intermediate compression cavity C2 and the second intermediate compression cavity C3 is less than the pressure of the fluid in the discharge chamber 23, the valve flap 220 returns to the closed position under the elastic restoring force and the pressure difference, thereby sealing the variable volume ratio orifice 64.

The compressor according to the first embodiment of the present disclosure having a set of intermediate compression cavities C2, C3 is exemplarily showed, in which only a single variable volume ratio orifice 64 may be formed in the end plate 44A, and only a single valve flap with a single movable part may be needed to selectively open and close the variable volume ratio orifice 64. Therefore, compared with the compressor according to the first comparative example, the compressor according to the first embodiment of the present disclosure may have a greatly reduced installation space for the VVR valve, and may avoid the possibility that the VVR function cannot be realized due to limited space. In addition, compared with the compressor according to the second comparative example, the compressor according to the first embodiment of the present disclosure may avoid using additional cover plate 220, sealing gasket 250 and corresponding fasteners, reduce processing cost and component cost, and prevent fluid leakage which would otherwise occur in the high-pressure discharge area between the cover plate and the fixed scroll end plate. In addition, since the VVR valve 200, which has a simple structure and has been conceived by the inventor, is adopted according to the first embodiment of the present disclosure, there is no need to develop additional new parts, so the development of the VVR function in the compressor is less difficult and fast. The compressor according to the first embodiment of the present disclosure has high structural compatibility and is applicable to most scrolls, and can be quickly improved to have the VVR function, e.g., by machining orifices on the un-improved scroll.

Figure 5:
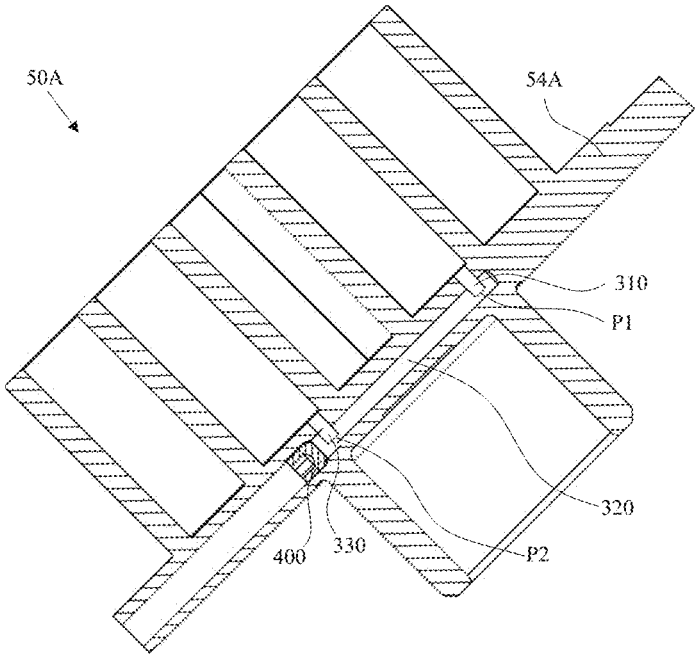
FIG. 5 schematically shows a plug mounted in a transverse connecting section according to an embodiment of the present disclosure.
Figure 6:
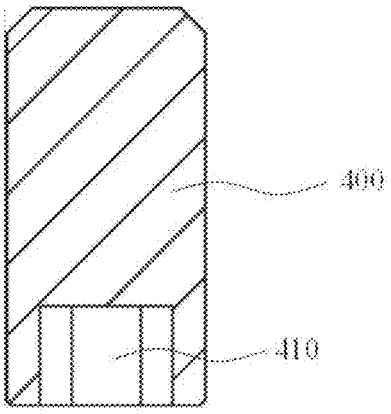
FIG. 6 shows details of a plug according to an embodiment of the present disclosure.
Figure 7:
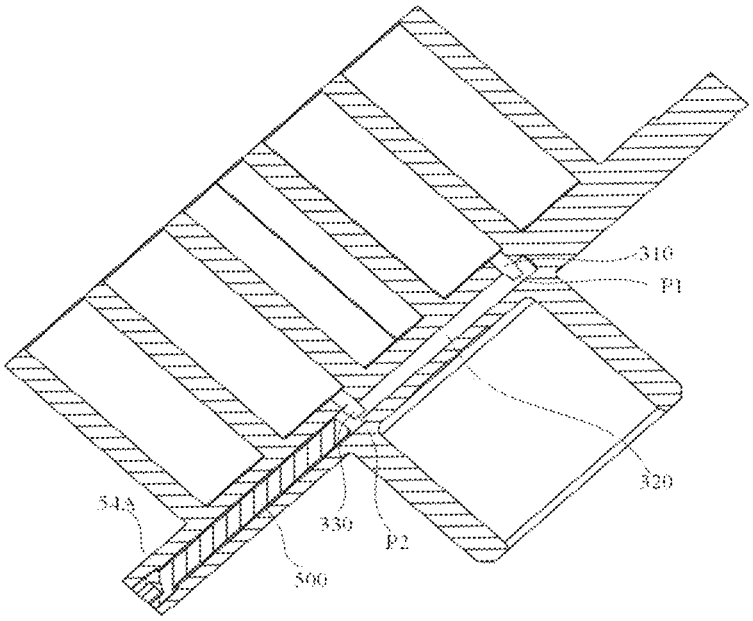
FIG. 7 schematically shows a plug mounted in a transverse connecting section according to another embodiment of the present disclosure.
Figure 8:
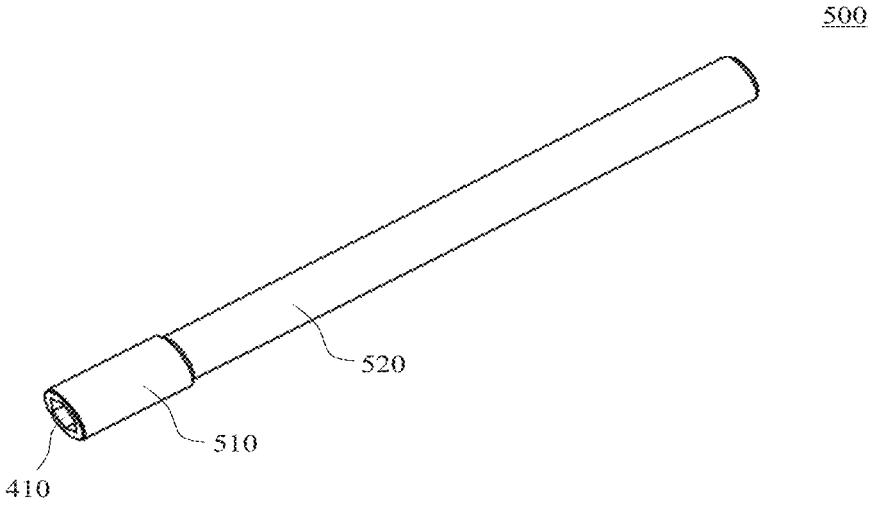
FIG. 8 shows details of a plug according to another embodiment of the present disclosure.

According to an embodiment of the present disclosure, a plug is provided in the transverse connecting section 320 to reduce the clearance volume. As shown in FIG. 5, since the first axial section 310 and the second axial section 330 intersect the transverse connecting section 320 at the first position P1 and the second position P2 located inside the end plate respectively, it is difficult to form a transverse channel by directly drilling between the positions P1 and P2 inside the end plate 54A according to the existing processing method. Instead, the transverse connecting section 320 must be drilled from the outer side of the end plate 54A (for example, the left side shown in FIG. 5) and extends to the point P1 intersecting the first axial section 310. Therefore, only the part between the intersection points P1 and P2 of the transverse connecting section 320 is necessary to form the fluid channel 300 (hereinafter referred to as the first part), the remaining part from the origin of drilling on the left to the intersection point P2 (hereinafter referred to as the second part) is an invalid part caused by the machining process. Since there is residual discharged fluid in the transverse connecting section 320 after the VVR valve is closed, the ineffective second part may cause the clearance volume of the compressor to increase, thereby reducing the efficiency of the compressor. According to an embodiment of the present disclosure, a plug may be provided in the transverse connecting section 320 to separate the first part and the second part, so as to reduce the clearance volume of the compressor.

Referring to FIGS. 5 to 8, a specific embodiment including a transverse connecting section with a plug mounted according to the present disclosure is described. In the embodiment shown in FIG. 5, the plug 400 has a shape of short threaded stud, and a tool engaging groove 410 is formed on one end surface of the plug 400. An internal thread is formed over an entire length of the second part of the transverse connecting section 320, and a length of the plug 400 is smaller than a length of the second part. The tool engaging groove 410 on the plug 400 may be engaged with a tool such as a screwdriver, so that the plug 400 can be screwed into the second part and fixed at the position where the second part is adjacent to the first part, so as to separate the first part from the second part. In the embodiment shown in FIGS. 7 and 8, the plug 500 is in the shape of an elongated step, and the transverse connecting section 320 is formed with internal threads only at the left end thereof. The plug 500 includes a first cylindrical portion 510 and a second cylindrical portion 520 with a diameter slightly smaller than the first cylindrical portion. The outer peripheral surface of the first cylindrical portion is formed with an external thread for engaging with the internal thread, and the second cylindrical portion may have a sufficient length filled in the second portion.

Figure 9:
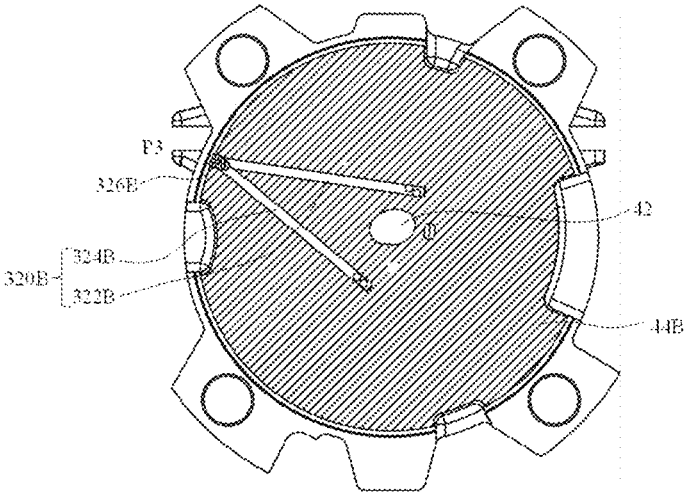
FIG. 9 schematically shows the fixed scroll of the compressor according to the second embodiment of the present disclosure.
Figure 10:
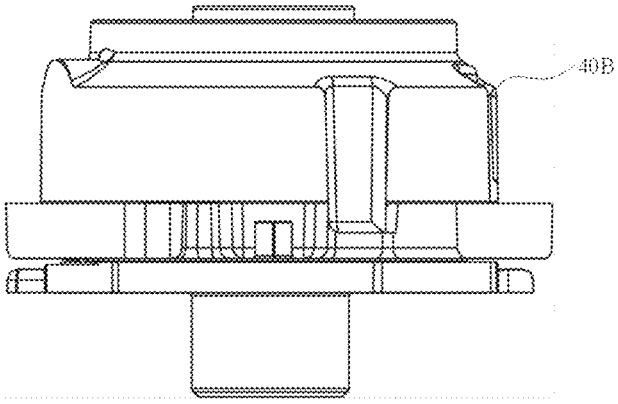
FIG. 10 schematically shows a scroll mechanism of a compressor according to the second embodiment of the present disclosure.
Figure 11:
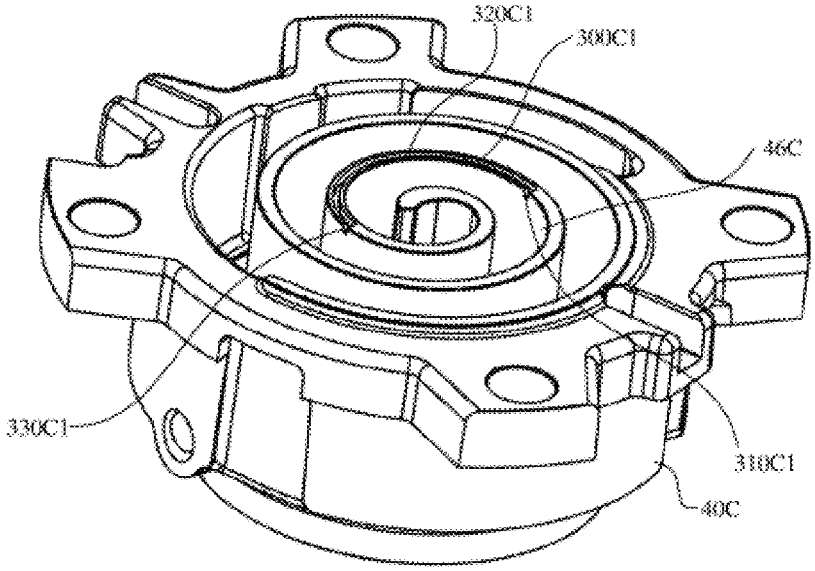
FIG. 11 schematically shows the fixed scroll of the compressor according to the third embodiment of the present disclosure.
Figure 12:
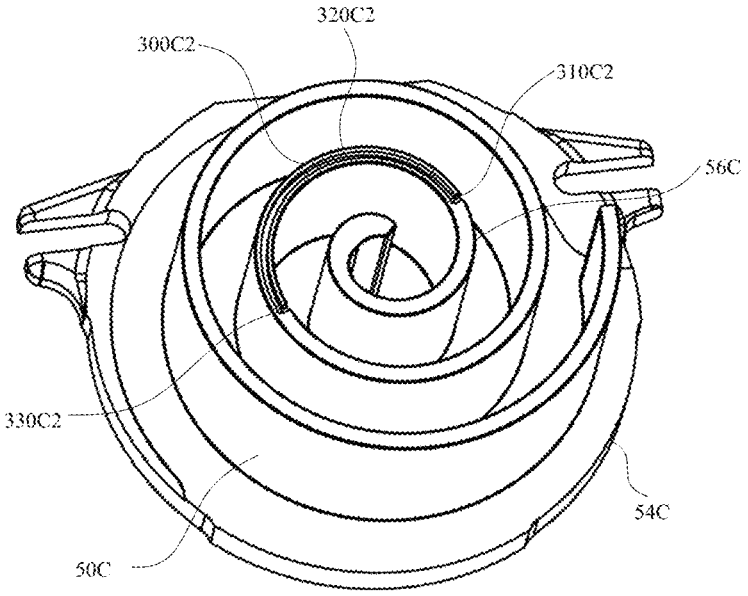
FIG. 12 schematically shows the movable scroll of the compressor according to the third embodiment of the present disclosure.
Figure 13:
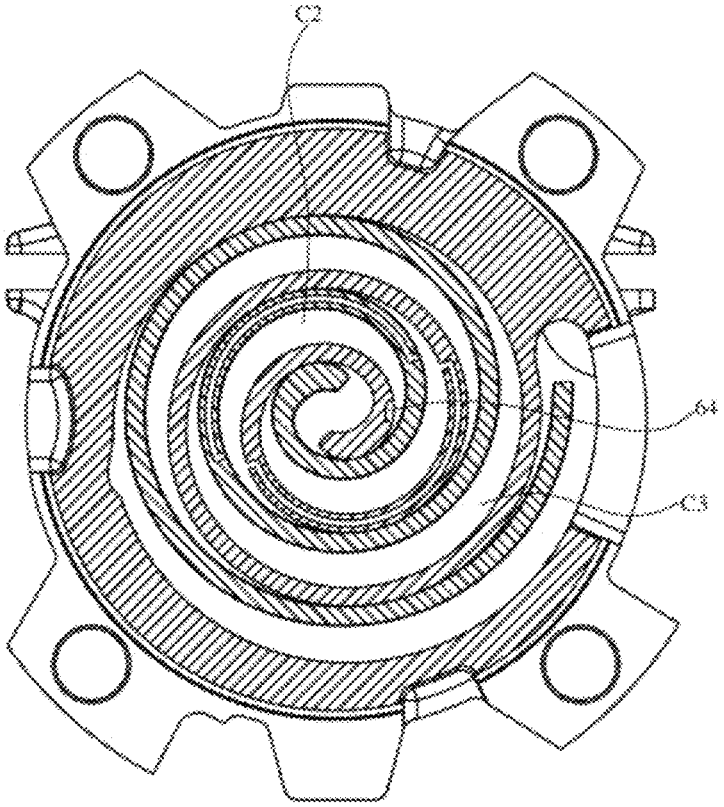
FIG. 13 schematically shows a scroll mechanism of a compressor according to the third embodiment of the present disclosure.
Figure 14A:
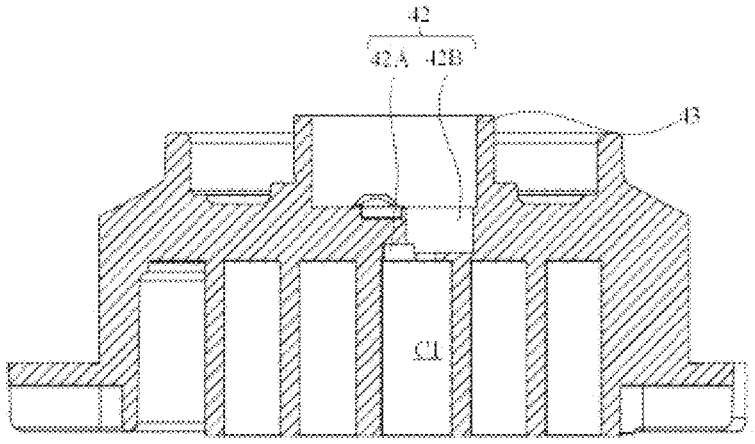
FIGS. 14A and 14B schematically show arrangement of the discharge port of a compressor according to an embodiment of the present disclosure.
Figure 14B:
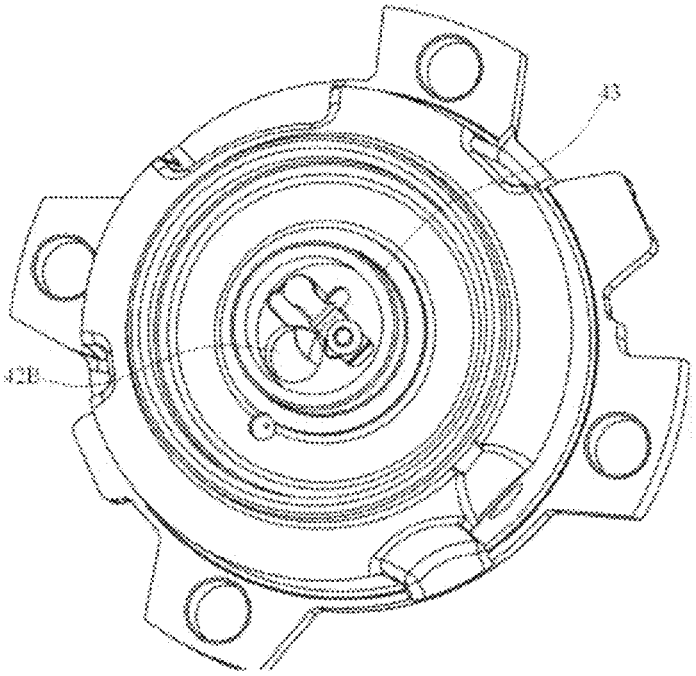

Referring to FIGS. 9 and 10, there is provided a scroll mechanism of a compressor according to a second embodiment of the present disclosure. The fixed scroll 40B depicted in FIG. 9 to FIG. 10 is used instead of the fixed scroll 40 according to the first comparative example, and other structures of the scroll compressor are basically unchanged.

The end plate 44B of the fixed scroll 40B is provided with a fluid channel that directly communicates the first intermediate compression cavity with the second intermediate compression cavity. Like the fluid channel 300 according to the first embodiment, the fluid channel of the end plate 44B may include a first axial section 310, a second axial section 330, and a transverse connecting section 320B. The first axial section and the second axial section may extend along the axial direction of the compressor and communicate with the first intermediate compression cavity and the second intermediate compression cavity respectively, and the transverse connecting section 320B may extend in a transverse direction perpendicular to the axial direction of the compressor and connect the first axial section and the second axial section. The transverse connecting section 320B according to the second embodiment may be formed as a single section similarly to the transverse connecting section 320 according to the first embodiment. However, since the discharge port 42 is formed in the end plate 44B of the fixed scroll 40B, in order to avoid the transverse connecting section 320B from being affected by the discharge port 42 in the end plate 44B, the transverse connecting section 320B may include a first transverse connecting section 322B and a second transverse connecting section 324B disposed on opposite sides of the discharge port 42 so that the transverse connecting section 320B bypasses the discharge port 42. The first transverse connecting section 322B and the second transverse connecting section 324B may intersect at the periphery portion P3 of the end plate 44B of the fixed scroll 40B, and a seal 326B may be provided at the intersection P3 to prevent fluid in the first intermediate compression cavity and the second intermediate compression cavity from being discharged through the periphery portion P3.

The working principle and advantages of the compressor according to the second embodiment of the present disclosure are the same as the working principle and advantages of the compressor according to the first embodiment of the present disclosure, and will not be repeatedly described here.

Next, with reference to FIGS. 12 to 14B, the scroll mechanism of the compressor according to the third embodiment of the present disclosure will be described. In the third embodiment according to the present disclosure, a fluid channel 300C1 is provided in the volute 46C of the fixed scroll 40C, and includes a first slot 310C1, a second slot 330C1, and a connecting section (that is, corresponding to the trench according to the present disclosure) 320C1. The first slot 310C1 and the second slot 330C1 may respectively communicate with the first intermediate compression cavity C2 and the second intermediate compression cavity C3, and the transverse connecting section 320C1 may extend along the spiral volute 46C and connect the first slot 310 and the second slot 330. Similarly, the volute 56C of the movable scroll 50C according to the third embodiment of the present disclosure is provided with a fluid channel 300C2. The fluid channel 300C2 includes a first slot 310C2 and a second slot 330C2 that communicate with the first intermediate compression cavity C2 and the second intermediate compression cavity C3 respectively, and a connecting section (that is, corresponding to the trench according to the present disclosure) 320C2 extending along the spiral volute 56C and connecting the first slot 310C2 and the second slot 330C2. Preferably, in the third embodiment of the present disclosure, the fluid channels 300C1 and 300C2 are formed at the free ends of the volutes, thereby facilitating the processing of the fluid channels and reducing the influence on the strength of the volutes.

In the third embodiment according to the present disclosure, it is shown that the first intermediate compression cavity and the second intermediate compression cavity are communicated by both the fluid channel 300C1 formed in the volute 46C of the fixed scroll and the fluid channel 300C2 formed in the volute 56C of the movable scroll. However, it should be understood by those skilled in the art that the fluid communication between the first intermediate compression cavity and the second intermediate compression cavity can be realized by forming a fluid channel only on one of the volute 46C of the fixed scroll and the volute 56C of the movable scroll.

The working principle and advantages of the compressor according to the third embodiment of the present disclosure are the same as the working principle and advantages of the compressor according to the first embodiment of the present disclosure, and will not be repeatedly described here.

In each of the above embodiments, the discharge port 42 is provided in the center of the end plate 44 of the fixed scroll 40, and in the case where the space defined by the inner annular wall 43 is very limited, this centrally arranged discharge port may interfere with the arrangement of the VVR valve. As such, the VVR valve may at least partially extend over the central discharge port 42, so that the high-pressure fluid discharged through the central discharge port 42 may act on the valve flap of the VVR valve, causing the VVR valve to discharge the under-compressed fluid in advance when over-compression does not occur. In order to solve the above problem, referring to FIGS. 14A and 14B, in an embodiment according to the present disclosure, the discharge port 42 includes a first discharge port portion 42A and a second discharge port portion 42B that communicate with each other. The first discharge port portion 42A is located in the center of the end plate 44 of the fixed scroll 40 and is in fluid communication with the central compression cavity C1, and the second discharge port portion 42B is offset from the first discharge port portion 42A in the radial direction and is in fluid communication with the discharge area defined by the inner annular wall 43. In the compressor according to the present disclosure, since the second discharge port portion 42B located at the upper part of the axial direction is offset from the first discharge port portion 42A located at the center of the end plate at the lower part, thereby reducing the interference of the discharge port 42 to the VVR valve and providing a larger installation space for the VVR valve.

Although some embodiments and variations of the present disclosure have been described in detail, it should be understood by those skilled in the art that the present disclosure is not limited to the embodiments and variations described above and illustrated in figures but may include other various possible combination and conjunction. Other variations and modifications can be implemented by those skilled in the art without departing from the essence and scope of the present disclosure. All these modifications and variations fall within the scope of the present disclosure. Moreover, all the members described herein can be replaced by other technically equivalent members.

The invention claimed is:

1. A scroll compressor, comprising:

a movable scroll comprising a movable scroll end plate and a movable volute formed on one side of the movable scroll end plate; and a fixed scroll comprising a fixed scroll end plate and a fixed volute formed on one side of the fixed scroll end plate, wherein the fixed scroll and the movable scroll are engaged to form a series of compression cavities therebetween, the series of compression cavities comprise a central compression cavity and intermediate compression cavities located radially outside of the central compression cavity, the intermediate compression cavities comprises at least a set of first intermediate compression cavity and second intermediate compression cavity; and a main discharge port and an auxiliary discharge port provided in the fixed scroll end plate;

wherein a fluid channel is provided between the first intermediate compression cavity and the second intermediate compression cavity to selectively communicate with a discharge area, the first intermediate compression cavity and the second intermediate compression cavity are directly communicated through the fluid channel; and wherein the main discharge port is in fluid communication with the central compression cavity, and the auxiliary discharge port is shared by the first intermediate compression cavity and the second intermediate compression cavity and is selectively in fluid communication with the discharge area.

2. The scroll compressor according to claim 1, wherein the fluid channel is provided on at least one of the fixed volute and the movable volute.

3. The scroll compressor according to claim 2, wherein the fluid channel comprises a trench provided on an end surface of a free end of the fixed volute and/or the movable volute, and a first slot and a second slot extending from the trench and communicating with the first intermediate compression cavity and the second intermediate compression cavity respectively.

4. The scroll compressor according to claim 1, wherein an inner annular wall is formed on the side of the fixed scroll end plate opposite to the fixed volute, the main discharge port and the auxiliary discharge port are arranged radially inside of the inner annular wall, and the discharge area is defined by the inner annular wall; and a variable volume ratio valve is provided at the auxiliary discharge port, the variable volume ratio valve allows fluid to flow from the first intermediate compression cavity and the second intermediate compression cavity into the discharge area, and prevents fluid in the discharge area from flowing into the first intermediate compression cavity and the second intermediate compression cavity.

5. The scroll compressor according to claim 4, wherein the variable volume ratio valve comprises a single valve flap covering a variable volume ratio orifice and a valve stop controlling the maximum movement range of the valve flap, the valve flap comprises a fixed part and a single movable part, the movable part is movable between an open position and a closed position with respect to the fixed part.

6. The scroll compressor according to claim 1, wherein the fluid channel comprises a first section communicating with the first intermediate compression cavity, a second section communicating with the second intermediate compression cavity, and a connecting section connecting the first section and the second section.

7. The scroll compressor according to claim 6, wherein the fluid channel is arranged in the fixed scroll end plate, the connecting section comprises a first connecting section communicating with the first section and a second connecting section communicating with the second section, the first connecting section and the second connecting section intersect, the auxiliary discharge port is in direct fluid communication with one of the first intermediate compression cavity and the second intermediate compression cavity.

8. The scroll compressor according to claim 7, wherein the connecting section has a first end penetrating the fixed scroll end plate or the movable scroll end plate, and a plug is provided at the first end to prevent fluid leakage.

9. The scroll compressor according to claim 6, wherein the fluid channel is provided in the movable scroll end plate, and the connecting section is formed as a single section, the auxiliary discharge port is in direct fluid communication with one of the first intermediate compression cavity and the second intermediate compression cavity.

10. The scroll compressor according to claim 9, wherein the connecting section has a first end penetrating the fixed scroll end plate or the movable scroll end plate, and a plug is provided at the first end to prevent fluid leakage.

11. A scroll compressor, comprising:

a movable scroll comprising a movable scroll end plate and a movable volute formed on one side of the movable scroll end plate; and a fixed scroll comprising a fixed scroll end plate and a fixed volute formed on one side of the fixed scroll end plate, wherein the fixed scroll and the movable scroll are engaged to form a series of compression cavities therebetween, the series of compression cavities comprise a central compression cavity and intermediate compression cavities located radially outside of the central compression cavity, the intermediate compression cavities comprises at least a set of first intermediate compression cavity and second intermediate compression cavity;

wherein a fluid channel is provided between the first intermediate compression cavity and the second intermediate compression cavity to selectively communicate with a discharge area, the first intermediate compression cavity and the second intermediate compression cavity are directly communicated through the fluid channel, and wherein the fluid channel is provided on at least one of the fixed volute and the movable volute.

12. The scroll compressor according to claim 11, wherein the fluid channel comprises a first section communicating with the first intermediate compression cavity, a second section communicating with the second intermediate compression cavity, and a connecting section connecting the first section and the second section.

13. The scroll compressor according to claim 11, wherein the fluid channel comprises a trench provided on an end surface of a free end of the fixed volute and/or the movable volute, and a first slot and a second slot extending from the trench and communicating with the first intermediate compression cavity and the second intermediate compression cavity respectively.

* * * * *